United States Patent [19]

Schudy

[11] 4,208,146

[45] Jun. 17, 1980

[54] SUSPENSION DEVICE FOR RING BINDERS

[75] Inventor: Karl-Hein Schudy, Espelkamp, Fed. Rep. of Germany

[73] Assignee: Robert Krause KG, Espelkamp, Fed. Rep. of Germany

[21] Appl. No.: 943,267

[22] Filed: Sep. 15, 1978

[30] Foreign Application Priority Data

Sep. 20, 1977 [DE] Fed. Rep. of Germany ..... 2742205

[51] Int. Cl.[2] ..... B42F 13/40; B42F 15/00

[52] U.S. Cl. ..... 402/4; 402/80 R; 312/184

[58] Field of Search ..... 281/1, 15 A; 312/184, 312/185; 211/45–47; 40/535, 536; 402/4, 24, 26, 80

[56] References Cited

U.S. PATENT DOCUMENTS

| | | | |
|---|---|---|---|
| 3,763,582 | 10/1973 | Stevens et al. | 40/536 |
| 3,801,175 | 4/1974 | Giulie | 312/184 |
| 3,936,201 | 2/1976 | Kenney et al. | 402/4 |
| 4,009,784 | 3/1977 | Elias et al. | 211/46 |

*Primary Examiner*—Paul A. Bell

*Attorney, Agent, or Firm*—Jordan & Hamburg

[57] ABSTRACT

An accessory suspension device for an existing binder is formed by an angle strip having slides which can be pulled out so as to project from opposite ends of the spine to suspend the binder. The device fits on the rings of the ring mechanism of the binder and acts to support the ring portions which actually carry the sheets of paper contained in the binder when the binder is suspended by the device.

16 Claims, 7 Drawing Figures

SUSPENSION DEVICE FOR RING BINDERS

Prior Application: Priority, Federal Republic of Germany, Sept. 20, 1977 Application No. P 27 42 205.5.

The invention relates to a suspension device for a ring binder.

In a known suspension device of this kind, the suspension members are constructed in the form of slides which are fitted and located between the underside of the ring mechanism and the binder cover itself. The slides can be pulled out from positions under the ends of the ring mechanism into projected positions for hanging the binder, and the slides are provided with locking members which, in their hanging position co-operate with the ring-coil or ring-rail portions of the ring mechanism to fix them and thus lock the rings in their closed position.

Such a construction of suspension device has proved extremely satisfactory but presupposes fitting it below the ring mechanism before the ring mechanism is united with the binder cover.

The object of the present invention is to provide a structurally simple suspension device for a ring binder which can be used as an accessory device for suspending existing ring binders.

In order to solve this problem, a suspension device for a ring binder according to the present invention has two suspension members which can be supported on the ring mechanism and which can be moved between retracted positions within the contours of the binder cover and extended positions in which they project from opposite ends respectively of the binder spine and offer a support for hanging the ring binder, the suspension members being disposed on a carrier having openings for locating it on the rings of the ring mechanism.

Such a construction renders it possible to add a suspension device to a ring binder of conventional construction, as desired and at any desired moment, to adapt it for suspension in a filing system.

The carrier may consist of an angled profile bar having a suspension arm with holes for suspending it on at least two rings of a ring binder and a supporting arm which extends substantially at right angles to the suspension arm and on which the suspension members are slidably mounted.

With this construction, the insertion of the suspension device is effected by suspending it in the rings of the ring mechanism in the manner of the sheet material to be filed, the carrier being aligned and located on the rings and counteracting opening of the rings. Such alignment and location is additionally reinforced by sheet material filed in the binder.

In another embodiment the carrier is formed by two angled profile members which are each connected to a suspension member and which each comprise a suspension arm provided with holes for receiving two rings of the ring mechanism of the binder and a supporting arm extending substantially at right angles to this, the supporting arm comprising a unilateral extension forming the suspension member, the holes for the rings being constructed in the form of sliding and gripping slots aligned parallel to the angled edges of the angled profile members and each comprising a widened portion at its end adjacent to the suspension member.

With this construction, the angled profile members, provided with the suspension members, are displaceable relative to one another in the longitudinal direction of the ring mechanism and are located by the gripping of the rings of the ring mechanism in the holes so that the suspension arms of the angled profile members also fulfil a holding-down function.

Specific embodiments of the present invention will now be described by way of example, and not by way of limitation, with reference to the accompanying drawings in which.

Figure 1:
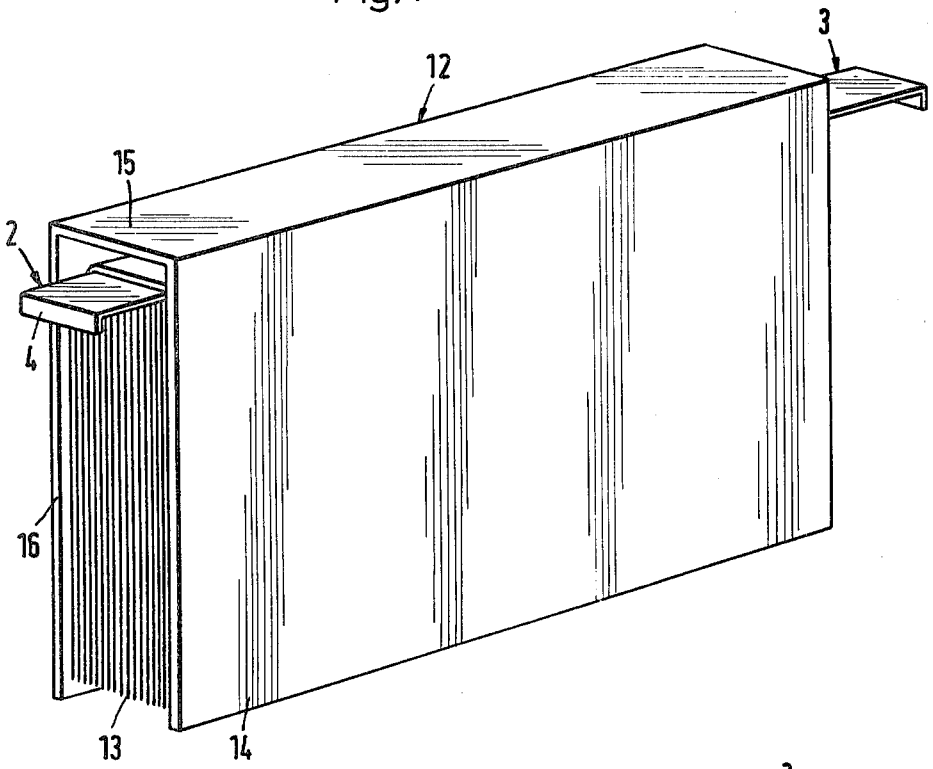
FIG. 1 is a perspective general view of a ring binder with a suspension device according to the invention, the binder being shown in the hanging position.
Figure 2:
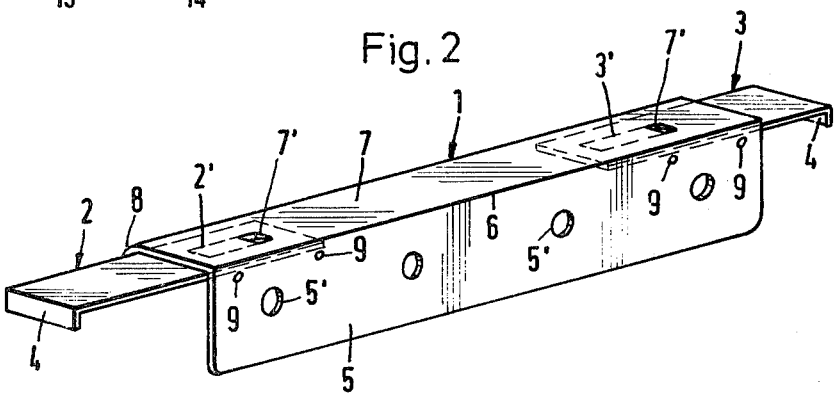
FIG. 2 is a perspective individual illustration of the suspension device in the hanging position, with extended suspension members.

With reference now to the accompanying drawings, the suspension device illustrated partially in FIG. 1 and completely in FIG. 2, consists, in detail, of an angled profile bar 1 and two suspension members 2, 3 which are constructed in the form of flat slides and are provided at their outer ends each with a web 4. The bar 1 has a suspension arm 5 in which, in the example illustrated, passages in the form of round holes 5' are provided.

Directed at a angle along the longitudinal angled edge 6 of the bar 1, at right angles to the suspension arm 5, is a supporting arm 7 which has a U-shaped channel 8 at its opposite longitudinal edge. This channel 8 forms a longitudinal guide for supporting and guiding the outer edge of the slides 2, 3, which bear flat against the underside of the supporting arm 7, that is to say, its side adjacent the suspension arm 5, when the angled profile bar 1 is in the hanging position. In order to support and guide the slides 2, 3 at their opposite inner edge, the suspension arm 5 has projections 9 in the form of stampings projecting therefrom on the side of the slides. The slides 2, 3 are provided each with a recess 2', 3' in the form of an elongated slot in which a stamped out tongue 7', bent out of the plane of the supporting arm 7, engages as a stop. This construction provides a simple but reliable support for the slides 2, 3 on their carrier 1 and limits their displacement when they are pulled out into their hanging position illustrated in FIGS. 1 and 2.

Figure 3:
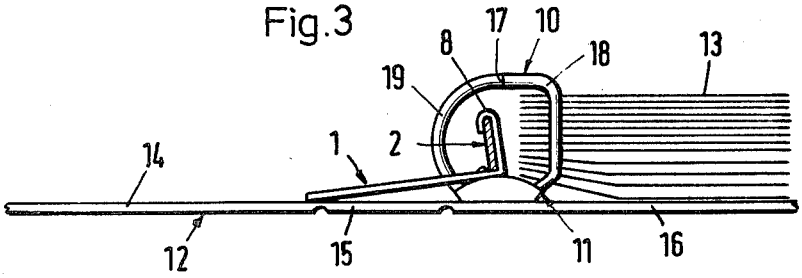
FIG. 3 is a broken away end view of an open ring binder with a suspension device constructed as in FIG. 2 but placed in the inoperative position.

The suspension device illustrated in FIG. 2 is hung on the rings 10 of the ring mechanism 11 of a ring binder 12 in the manner of sheets 13 to be filed, as can be seen better from FIGS. 3 to 6. FIG. 3 illustrates the ring binder 12 in the open position in which the front cover 14, the spine 15 and the rear cover 16, to which the ring mechanism 11 is secured close to and parallel with the spine portion 15, are in a common plane. In this position of use of the ring binder, the rings 10, which are divided at a joint 17, can be opened and closed and sheets can be transferred from the ring portion 18 to the ring portion 19 or vice versa, without the suspension device 1, 2 getting in the way. The suspension device can, however, also be removed from the ring binder when the ring binder is not required to be hung up. When the ring binder is to be hung up, the suspension device is folded over and, as a result, the suspension arm is transferred to the ring portion 18 and into the position which can be seen in FIGS. 4 and 5. The outer marginal regions of the holes 5', adjacent to the outer longitudinal edge of the suspension arm 5 opposite the edge 6 are spaced from the edge 6 such that these outer marginal regions of the holes 5' engage under the ring portions 18 of the ring mechanism 11 carrying the sheet material, in the hanging position, while the suspension arm 5 bears with its outside face, remote from the supporting arm 7, against both ring portions 18, 19 of the rings 10 of the ring mechanism 11 at each side of the joint 17. The spacing is, of course, chosen depending upon the shape and dimensions of the rings. This means that the weight of the ring binder is transmitted to the suspension device through the lower, loaded ring portion 18, when the ring binder is in the hanging position with the result that the opening of the rings, in the hanging position of the ring binder, under the weight of the inserted sheets, is avoided. The bar 1 is aligned on the rings themselves, this alignment being made more stable as more sheets are added to the ring binder. With ring shapes as illustrated in FIGS. 3 to 6, wherein there is a substantially rectilinear ring region at least at one side of the joint and adjacent thereto, the bar 1 is aligned on the rings by bearing against this straight ring region and the bar bears firmly against the rings of its own accord under the weight of the ring binder and aligning support from the sheets carried on the rings can be dispensed with. Where the rings have rounded ring portions at both sides of the joint, the reaction of the sheets carried by the rings and of the front cover 14 of the binder ensures the required alignment of the supporting arm 7 parallel to the spine 15 when the ring binder is in the hanging position.

Figure 6:
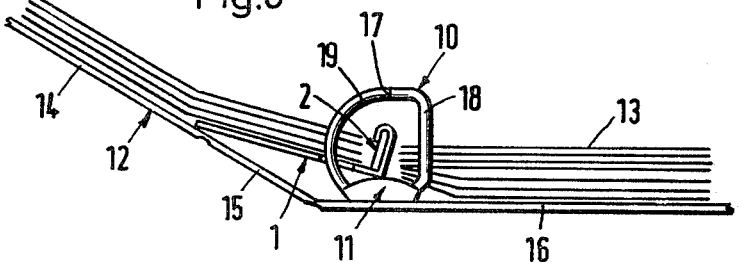
FIG. 6 shows a view similar to FIG. 3 to illustrate the auxiliary hinge function of a suspension device according to the invention having a widened suspension arm.

In the case of the suspension devices illustrated in FIGS. 3 to 6, the suspension arm 5 has a particular width between its longitudinal edges which corresponds to about one and a half times the height of the mechanism, so that it forms a hinge or turning aid for transferring sheets which are still on the ring portion 19 to the ring portion 18 when the ring binder is closed (FIG. 6). Particularly with such an embodiment, it may be desirable to make the passage 5' in the suspension arm 5 in the form of elongated slots with their longitudinal axes extending at right angles to the edge 6 so that the bar 1 has sufficient play to allow it to be transferred easily onto the ring portions 18 and into the hanging position.

Figure 7:
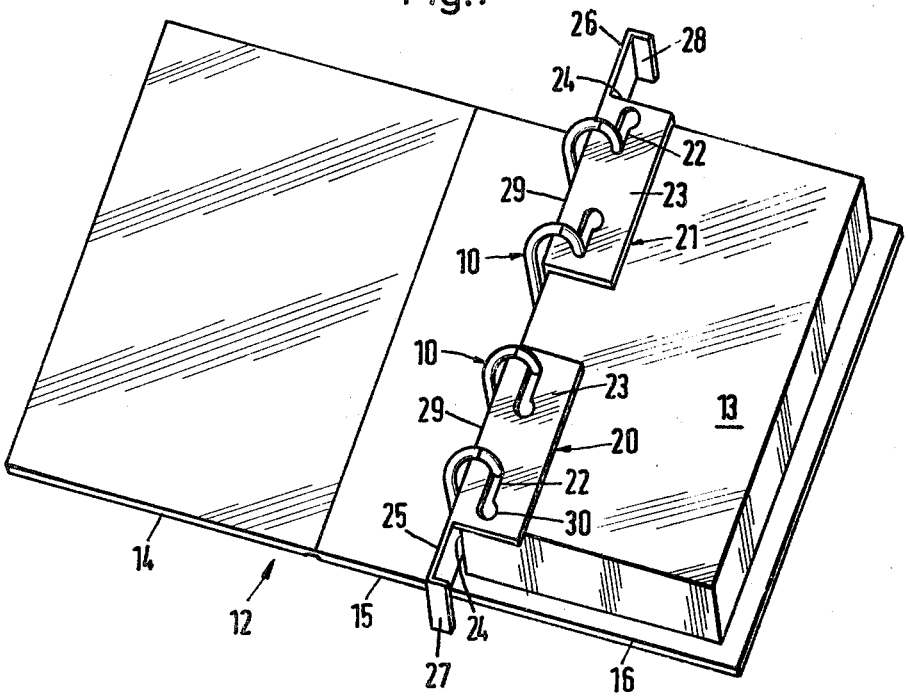
FIG. 7 shows a perspective view of a ring binder with a modified embodiment of suspension device according to the invention, the ring binder being in the open position.
Figure 4:
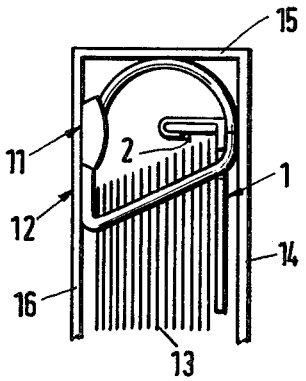
FIGS. 4 and 5 are borken away end views of ring binders having differently shaped rings but with a suspension device as shown in FIG. 2, the device being shown in the position for hanging the binder in each case.
Figure 5:
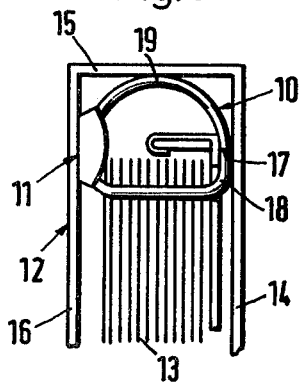

FIG. 7 shows a modified embodiment wherein the carrier is formed by two angled profile members 20, 21 which are each connected to a suspension member and which each comprise a suspension arm 23 provided with two passages 22 each receiving one of two adjacent rings 10 of the ring mechanism of a binder, and a supporting arm 24 extending at right angles to this, the supporting arm comprising a unilateral extension or suspension member 25, 26, with an outer web 27, 28. The passages 22 for the rings 10 are aligned parallel to the angled edge 29 of the angled profile members 20, 21 and form sliding and gripping slots which have a widened portion 30 at their ends adjacent the suspension member in each case.

FIG. 7 illustrates this suspension device in its hanging position before the ring binder is closed. In this position the angled members 20, 21 assume a position displaced outwardly as far as possible in the longitudinal direction of the ring mechanism, on the rings 10. In this position, the angled members 20, 21 are located by the gripping action of the rings in the slots 22 and at the same time form hold-down means for the sheets 13 in the binder. The angled members can be pushed back into the contours of the ring binder and at the same time released from their fixing on the rings so that they can be swung over so as to lie against the inside of the back of the binder or removed from the binder altogether.

I claim:

1. A suspension device comprising a ring binder having a spine and a cover pivotal relative to said spine, a ring mechanism having rings mounted on said ring binder, a one-piece rigid carrier having a suspension arm and a supporting arm extending substantially at right angles to said suspension arm, said suspension arm having holes for suspending the carrier on at least two rings of the ring mechanism, and suspension members slidably mounted on said support arm of said carrier for movement between a retracted position within the contours of the binder cover and an extended position in which the suspension members project from opposite ends respectively of the binder spine to provide for suspending the ring binder.

2. A device as claimed in claim 1 in which the suspension members are in the form of flat slides each having a web at its outer end and each slide bears flat against the supporting arm and is supported and guided at its longitudinal edge by guides formed on said carrier.

3. A device as claimed in claim 2 in which the slides are disposed flat against the side of the supporting arm adjacent the suspension arm, the supporting arm comprises a U-shaped channel supporting and guiding the outer longitudinal edges of the slides, and projections are provided on the suspension arm which support and engage the inner longitudinal edges of the slides.

4. A device as claimed in claim 3 in which the slides have recesses in the form of elongated slots and the supporting arm has projections which engage in the recesses and act as stops.

5. A device as claimed in claim 4 in which the projections are stamped out of the material of the supporting arm.

6. A device as claimed in claim 1 in which the outer marginal regions of the holes in the suspension arm remote from the angled edge of the angled carrier are disposed at such a distance from the angled edge of the angled carrier that, in the hanging position, the outer marginal regions of the holes engage and support the rings of the ring mechanism.

7. A device as claimed in claim 6 in which the suspension members are in the form of flat slides each having a web at its outer end and each slide bears flat against the supporting arm and is supported and guided at its longitudinal edge by guides formed on said carrier.

8. A device as claimed in claim 7 in which the slides are disposed flat against the side of the supporting arm adjacent the suspension arm, the supporting arm comprises a U-shaped channel supporting and guiding the outer longitudinal edges of the slides, and projections are provided on the suspension arm which support and engage the inner longitudinal edges of the slides.

9. A device as claimed in claim 8 in which the slides have recesses in the form of elongated slots and the supporting arm has projections which engage in the recesses and act as stops.

10. A device as claimed in claim 9 in which the projections are stamped out of the material of the supporting arm.

11. A device as claimed in claim 6 in which said holes are round.

12. A device as claimed in claim 6 in which said holes are elongated in a direction extending at right angles to the angled edge of the angled carrier.

13. A device as claimed in claim 1 in which said holes are round.

14. A device as claimed in claim 1 in which said holes are elongated in a direction extending at right angles to the angled edge of the angled carrier.

15. A device as claimed in claim 1 in which the suspension arm forms a broad support so as to act as a hinge aid for sheet material.

16. A suspension device for a ring binder having a cover and a ring mechanism comprising a carrier formed by two angled profile members which are each connected to a suspension member and which each comprise a suspension arm provided with holes for receiving two rings of the ring mechanism of the binder and a supporting arm extending substantially at right angles to this, the supporting arm comprising a unilateral extension forming the suspension member, the holes for the rings being constructed in the form of sliding and gripping slots aligned parallel to the angled edges of the angled profile members and each comprising a widened portion at its end adjacent to the suspension member, said suspension members being slidable for movement between a retracted position within the contours of the binder cover and an extended position in which the suspension members project from opposite ends respectively of the binder spine to offer support for hanging the ring binder.

* * * * *